United States Patent [19]

Batra

[11] Patent Number: 4,617,745

[45] Date of Patent: Oct. 21, 1986

[54] AIR SHOE

[76] Inventor: Vijay K. Batra, 4 Daybreak, Turkey Hill Village, Wayland, Mass. 01778

[21] Appl. No.: 709,863

[22] Filed: Mar. 8, 1985

Related U.S. Application Data

[63] Continuation-in-part of Ser. No. 523,265, Aug. 15, 1983, abandoned.

[51] Int. Cl.[4] ..... A43B 7/06

[52] U.S. Cl. ..... 36/3 B; 36/28; 36/29; 36/43

[58] Field of Search ..... 36/3 B, 3 R, 29, 44, 36/43, 28

[56] References Cited

U.S. PATENT DOCUMENTS

| | | | |
|---|---|---|---|
| 1,106,986 | 8/1914 | Stucki | 36/3 B |
| 2,259,559 | 10/1941 | Filsingeh | 36/43 |
| 2,641,068 | 6/1953 | Thompson | 36/44 |
| 2,736,109 | 2/1956 | Scholl | 36/44 |
| 2,979,835 | 4/1961 | Scholl | 36/3 B |
| 4,237,627 | 12/1980 | Turner | 36/29 |
| 4,319,412 | 3/1982 | Muller et al. | 36/29 |
| 4,364,186 | 12/1982 | Fukuoka | 36/29 |
| 4,438,573 | 3/1984 | McBarron | 36/3 B |

FOREIGN PATENT DOCUMENTS

| | | | |
|---|---|---|---|
| 209154 | 3/1940 | Switzerland | 36/3 B |

*Primary Examiner*—Werner H. Schroeder
*Assistant Examiner*—Mary A. Ellis
*Attorney, Agent, or Firm*—Frank A. Steinhilper

[57] ABSTRACT

An air shoe has a sole having a plurality of channels longitudinally and laterally in the upper surface of the sole, forming a multiplicity of sections at least partially surrounded by such channels. This sectionalized structure improves air flow beneath the wearer's foot as he walks, runs, or exercises, increases massagic action, and makes the shoe lighter and more flexible. An air flow slip sole is also placed on the sectioned sole, simultaneously contacting both the channels and the wearer's foot to increase air flow to the foot.

6 Claims, 10 Drawing Figures

AIR SHOEcl RELATED APPLICATIONS

This is a continuation-in-part of copending application Ser. No. 523,265, filed Aug. 15, 1983, now abandoned and is a substitute for application Ser. No. 72,143, filed Sept. 9, 1979.

BACKGROUND OF THE INVENTION

An air shoe as shown in Batra Ser. No. 72,143 is a shoe such as an athletic shoe, sneaker or the like, having ventilation passages to cause air to pass into the sole of the shoe and to cool the wearer's foot as the sole is alternately copmpressed and permitted to expand while the wearer runs or otherwise engages in sports or other activities. Air shoes are now quite common in commercial use.

Variations in air shoes have been proposed since Batra Ser. No. 72,143 and subsequent patent applications have been filed and/or patents issued by Batra and others disclosing such variations. For example, McBarron U.S. Pat. No. 4,438,573 provides air shoes like those of the original Batra invention but with reservoirs. Such reservoirs are in fact a step backwards, as they suffer the disadvantage of requiring extra air to ventilate the volume of the reservoir and, further, act as a reserve space to accumulate contimination which may be picked up as the wearer moves through puddles or other contamination as he walks or runs.

GENERAL NATURE OF THE INVENTION

A shoe according to the present invention has an outer sole of compressible material whose bottom surface may be designed or patterned as desired, for example to provide a desired tread for the shoe. An upper surface of such outer sole has at least one channel extending lengthwise from a position within the heel portion of the shoe to a position within the front or ball section of the sole, and a multiplicity of channels in the lateral direction passing across longitudinal channel or channels to divide the upper surface or layer of the sole into a number of sections, each section having surrounding channels which both bring air across the foot and also contribute flexibility to the sole structure. In the preferred embodiment the sole has at least two longitudinal channels. Normal patterns of compression of the sole as a wearer moves will distribute air beneath the foot of the wearer.

At the instep an open mouth whose lower surface is curved downwardly forms an opening or orifice joining at least one lateral channel to the outside or ambient air, thus providing a source of air for the channel structure and greatly reducing the possibility of contamination from external water.

In a presently preferred specific embodiment of the invention at least one longitudinal channel, preferably two or three such longitudinal channels, terminate in openings to the outside or ambient air at the rear of the shoe above the heel. This combination of openings at the rear of longitudinal channels and lateral opening at the instep causes air flow through the channels, thus additionally increasing the flow of fresh and cooling air to all areas within the shoe.

The outer edge of the upper surface of the sole is generally solid, either being free from channels or having channels of reduced depth, and the outer sole thus provides strong circumference support area. The lateral channels are generally of curved depth of indentation, being deeper at the center of the shoe and more shallow as they approach the edge of the sole. The sole extends beyond the outer line of the shoe upper.

In one further embodiment of the invention, the external air flow is connected to the front end of one or more longitudinal channels, thus providing through air flow from rear openings to the front end of the channel network.

In one embodiment of the invention there is a slip sole positioned on the upper surface of the outer sole, contacting the network of air channels and cooperatively contacting the wearer's foot within the sole. This slip sole has a thin solid outer area or rim for lasting, or fastening the shoe upper to the sole. The central portion within this area is spongy or porous and has an upper thin layer of mesh across the top and a thin foam body beneath the mesh, this foam body being made of polyurethane, rubber or the like. This slip sole is thin and exceptionally flexible, this being of great importance to athletes, and it circulates air from the channel pattern underneath and across essentially the entire foot area. If another insole is also used, this slip sole enhances such other insole, leaving it also flexible and improving air circulation under the wearer's foot.

In prior air shoes in actual public use there has been a solid intermediate layer or inner member positioned on the upper surface of the sole, this intermediate layer compressing against the channels of air reservoir. According to the present invention such intermediate layer is eliminated or replaced with the new special porous slip sole; this structure combined with the multiple channels and sectionalization significantly decreases shoe weight and further increases flexibility, particularly the ability of the individual sole sections to act invididually on the sole of the foot.

The general nature of the invention having been set forth, the invention may be more clearly inderstood in connection with the drawings, in which.

SPECIFIC DESCRIPTION OF THE INVENTION

Figure 1:
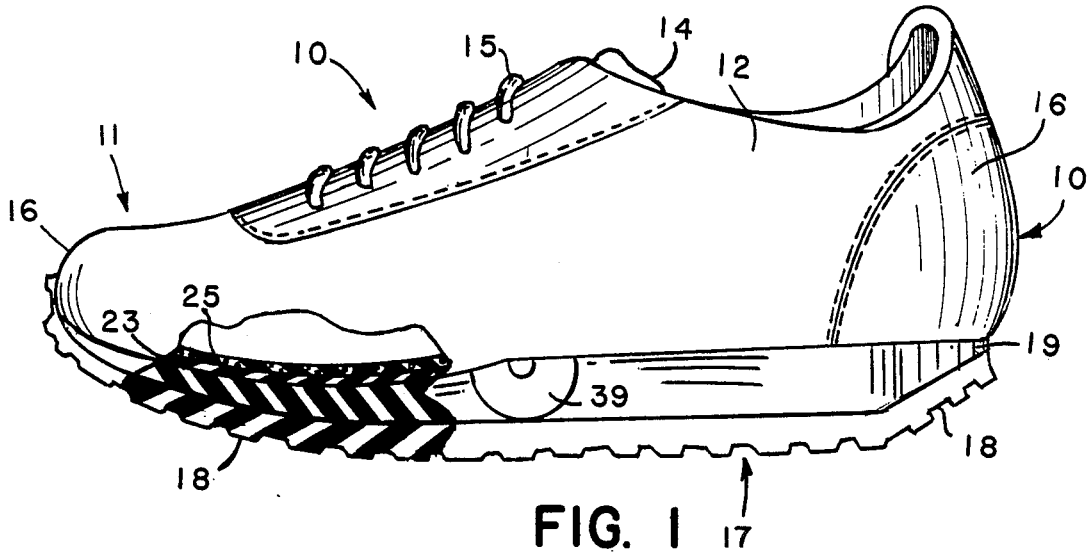
FIG. 1 is a side view of a shoe having an air cooled sole according to one embodiment of the invention.

In FIG. 1 is shown an athletic shoe generally designated 10 having an upper 11 of usual design including a casing 12, and toe and heel elements 16 and 16*a*. Lasted or secured to the bottom of the shoe upper 11 is an outer sole 17 comprising two sole body portions, a lower or tread body 18 and an upper sole body 19 secured together across the sole area. As shown, the main or upper sole body 19 has a lower or tread body 18 layered to it. Inside the show upper 11 are an inner sole 23 positioned against the upper surface of upper sole body 19. Positioned on inner sole 23 is a slip sole or lasting sole 25. The shoe upper 11 and the inner sole 23 are adapted to receive a wearer's foot in a manner conventional in shoe design and construction, with or without slip sole 25. Both inner sole 23 and slip sole 25 have openings leading from outer sole 17 to the shoe interior.

Figure 2:
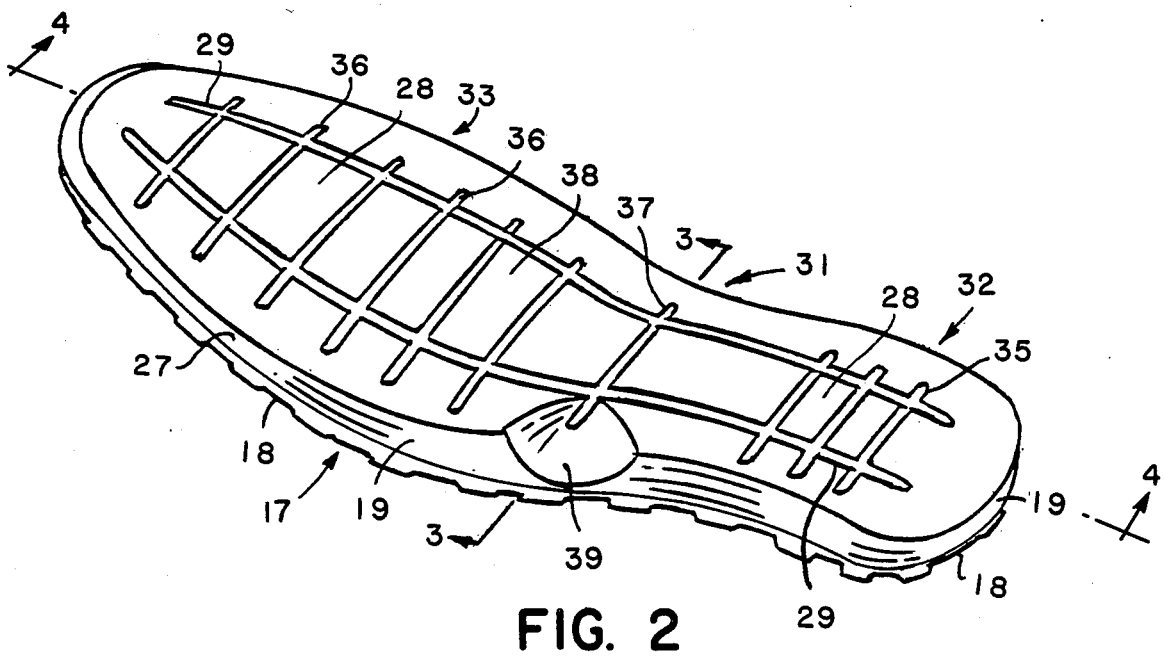
FIG. 2 is a top perspective view of an outer sole according to the embodiment of the invention shown in FIG. 1.

As shown in FIG. 2, outer sole 17 comprises tread body 18 secured to sole body 19, these two bodies 18 and 19 forming a unitary sole body. Tread body 18 extends forward beyond the front of sole body 19 and is adapted to curve upwardly around the toe of upper 11, as shown in FIG. 1. Tread body 18 is of suitable material and design, such as a rubber sole with a conventional tread design adapted to meet a surface on which the wearer is standing, walking or running. Tread body takes the major wear from use of the shoe. Upper sole body may be of the same or different composition as tread body 18.

The upper surface 27 of upper sole body 19 has two longitudinal channels 29 extending nearly the length of the sole body, terminating at the rear shortly in front of the heel end of the sole 17. Sole body 19 has an instep area generally designated 31, slightly narrower than the rest of the sole body 19, with a heel area generally designated 32, and with a ball area generally designated 33 adapted to be positioned beneath the ball of the foot of the wearer. Longitudinal channels 29 extend largely through the heel area 32, through the instep area 31 and into the ball area 33, reaching essentially to the area of the toes of the wearer. Within the heel area 32 are several lateral channels 35, three such channels being shown. Within the ball area 33 are several lateral channels 36, six such lateral channels being shown. In the instep area 31 is at least one lateral channel 37, one such channel being shown. In the embodiment of the invention shown in FIG. 2, the single lateral channel 37 in the instep area 31 interconnects with a port or mouth 39 which in turn communicates with the external environment.

Figure 3:
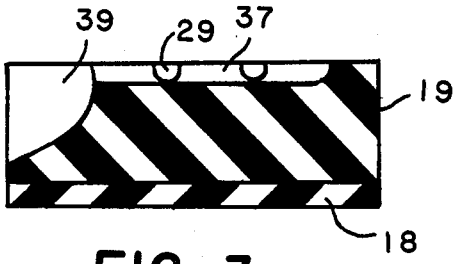
FIG. 3 is a rear cross section of the sole shown in FIG. 1, taken along the line 3—3.

On the upper surface 27 of sole body 19, the various longitudinal channels 29 and the lateral channels 35, 36 and 37 divide the sole body into a multiplicity of raised segments or compartments 38. As shown, the segments toward the center of sole body 19 are bounded on all sides by such channels 35, 36, 37, whereas at the edges of sole body 19 such sections are bounded on three sides by such channels and on the outer or edge side of the sections they are integrally formed into the sole body. Referring to FIG. 1 it is observed that instep channel 37 is at the throat of mouth 39 and is well raised above the level of the ground and generally will be above the height of a shallow puddle. As shown in FIG. 3, the bottom of mouth 39 slopes sharply downwardly toward the mouth opening, providing drainage for any water picked up at a puddle during use.

In FIG. 3 is shown in section the sole body 19 of the article shown in FIG. 1, having an outer sole or tread 18. Longitudinal channels 29 and 37 are shown, having a depth approximately the same as the depth of lateral channel 36 in the central shoe areas. As shown, the ends of lateral channel 36 have upwardly curving end portions reaching the surface 27 shown in FIG. 2 of the sole body a small distance short of the edge of the sole. In the Figure the ball portion of sole body 19 is wider than the body at the point of the cross section or instep, thus conforming with a typical foot shape.

Figure 4:
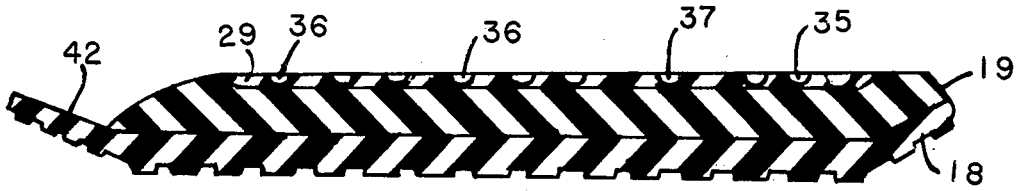
FIG. 4 is a side cross section of the sole shown in FIG. 1, taken along the line 4—4.

Similarly in FIG. 4 is shown the upper sole body 19 having a multiplicity of channels 36, 36 and 37 cut across the upper portion of the body. As can be seen in FIG. 4, the front section 42 of tread body 18 extends forward from the sole body, being adapted to be formed upwardly around the toe of shoe 10.

Figure 5:
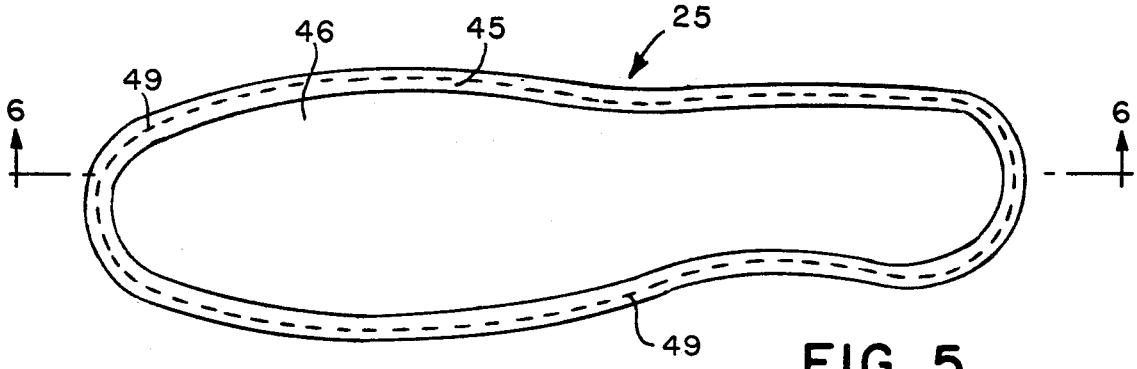
FIG. 5 is a top view of a slip sole according to one embodiment of the invention.
Figure 6:
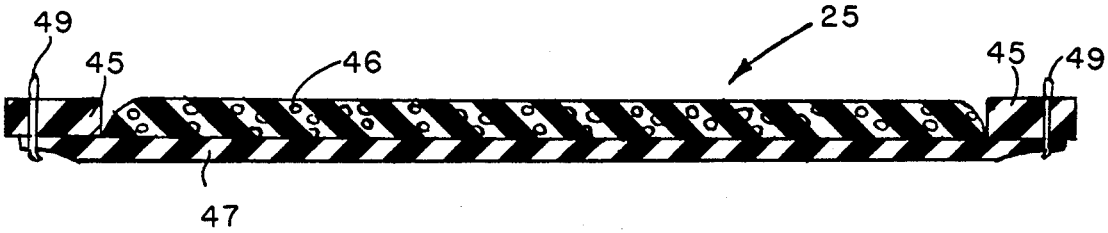
FIG. 6 is a side cross section of the slip sole shown in FIG. 5, taken along the line 6—6.

In FIG. 5 and FIG. 6 is shown a slip sole 25 having a solid outer frame 45 surrounding an inner air section having an upper foam layer 46 and a lower webbing area 47. Around the edges of frame 45 is stitching 49 or other means to fasten frame 45 to webbing 47.

The slip sole shown in FIGS. 5 and 6 can be used separately in ordinary shoes of other types and in air shoes of other kinds to carry air to the sole of the wearer's foot, breathing as the wearer's foot presses on the slip sole and releases pressure. It is well adapted to be joined with the shoe of FIG. 1 and with the sole of the other Figures to assist in foot breathing and in rapid spread of air throughout all foot and shoe areas. In particular, as air enters channels 29 and 36 of the shoe in FIG. 2 or other channels of a shoe, slip sole 25 promptly leads such air through all the channels and to all foot areas.

One procedure of manufacture contemplates that the channels may be cut into or ground into the sole body with a round grinding implement. Thus through the greater part of the length and width of the sole, lateral channels 36 and longitudinal channels 29 and 30 present a cross design of relatively uniform depth and channel width. In the embodiment shown in FIG. 1, this network of crossing channels communicates with the outside environment through instep channel 37 and directly with the underside of the wearer's foot through the porous slip sole.

Figure 7:
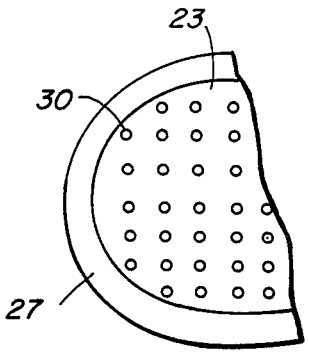
FIG. 7 is a fragmentary top view of a portion of the inner sole shown in FIG. 5.

FIG. 7 shows a fragment of insole 23 which, as shown, has a solid but flexible outer rim 27 and a perforated inner body with a multiplicity of holes 30 through the insole 23. The insole 23 is of a suitable material such as leather, plastic or the like. A very satisfactory material is a soft, flexible plastic material covered on its upper surface with a soft fibrous layer fitting comfortably against a wearer's foot. Holes 30 passing through the insole from its upper surface through to its lower surface act to permit the passage of air therethrough. These holes 30 may be of relatively small size such as a pinhole size or moderately larger than pinhole size.

Figure 8:
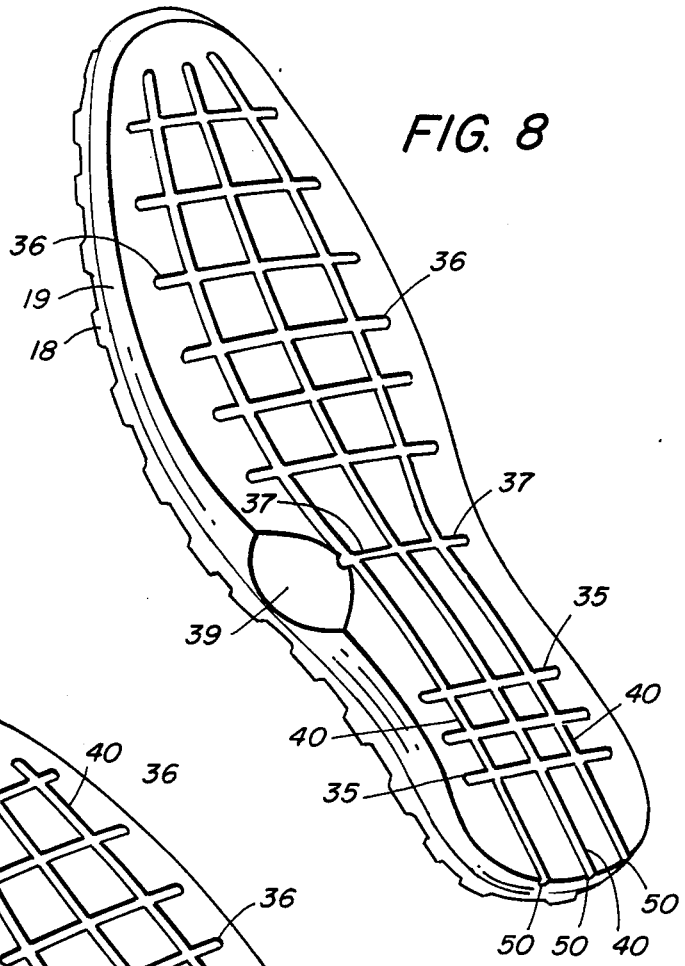
FIG. 8 is a top perspective view of an outer sole according to a further embodiment of the invention.

FIG. 8 shows a sole according to another embodiment of the invention, having an upper sole body 19 and a tread body 18, with a multiplicity of lateral channels 35 and 36 in the heel and ball areas and a lateral channel 37 in the instep area communicating with port 39, all as in FIG. 2. In FIG. 8 there are three longitudinal channels 40, extending to the rear ends of sole body 19, there terminating at heel openings 50. Shoe structure conventionally has a raised heel, with the result that these rear openings at the top of the heel body are raised above the level of most puddles and do not collect water and other external contamination; additionally the normal walking and running movements will drain out any small quantities of water that accidentally get into these rear openings.

Figure 9:
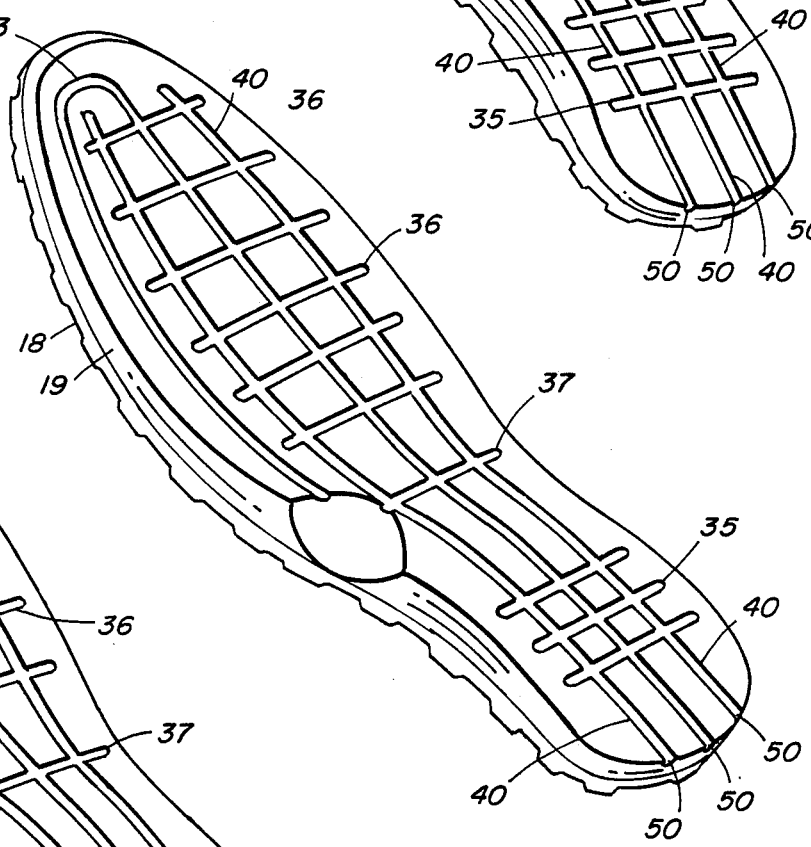
FIG. 9 is a top perspective view of an outer sole according to a still further embodiment of the invention.
Figure 10:
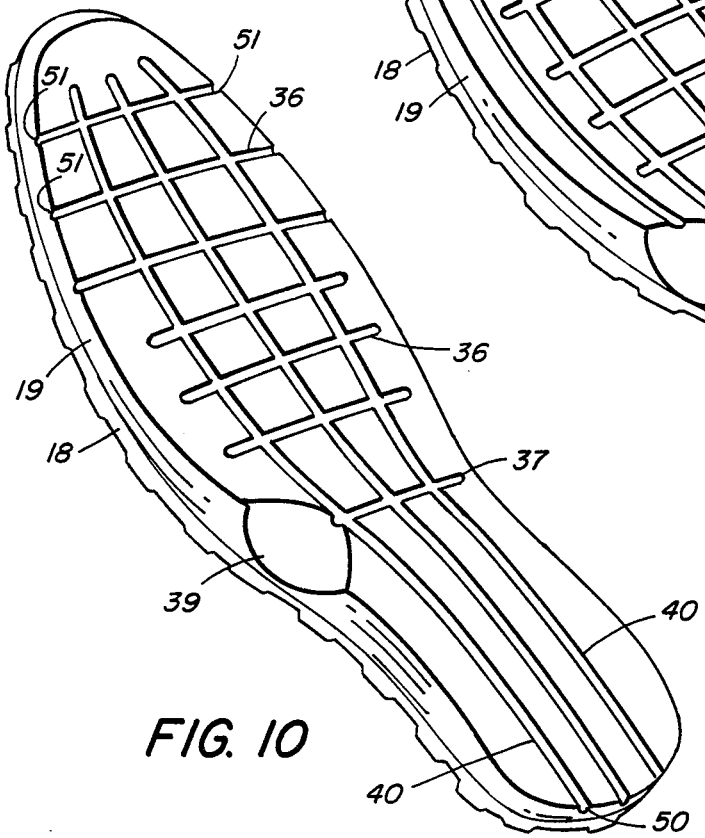
FIG. 10 is a top perspective view of an outer sole according to another embodiment of the invention.

In FIG. 9 is shown a still further embodiment of the invention having a sole body 19, a tread body 18, a plurality of lateral channels 35, 36 and 37, and an instep port 39, again as in FIG. 2. In FIG. 10 there are three longitudinal channels 40 extending to openings 50 at the rear ends of sole body 19. A fourth longitudinal channel 43 joins channels 40 and terminates at instep port 39, providing air flow from the rear of the heel through the sole area and to port 39.

In the various embodiments of the invention there is a network of crossing channels running substantially the length and width of the shoe, communicating with the outside air and carrying the air beneath the foot of the wearer. These channels 29, 35, 36 and 37 of FIG. 1 and any other longitudinal and lateral channels of the various embodiments also divide the sole into sections or segments 38, as shown. These individual sections 38 support the foot of the wearer at the individual area of each channel. Between the sections, the channels carry air from one position to another, lend flexibility to the sole by virtue of providing thinner sole portions, and in addition significantly decrease the weight of the sole. Since the sole 19 is a significant portion of the weight of the total shoe, this produces a significantly lighter and therefore, more desirable shoe.

The entire sole 19 is more flexible as a result of the channel flexibility, permitting the sole to bend more easily with the flexing of the foot during walking, running, or other activity. In addition, the individual sections 38 are flexibly movable with respect to one another. Thus one section 38 may be raised as a result of pressure from the surface on which the person is standing or moving, while an adjacent or nearby section is not thus raised. As a consequence, the sole helps to massage the foot during use, as each section individually moves in a massaging motion, and each section is individually compressed or released from compression, thus increasing the compression and expansion of the channels and the air in such channels. As the wearer moves, stepping from one foot to the other, the sole in general and the individual sections 38 are slightly compressed and expanded, causing channels 29, 35, 36 and 37 (or other channels of other FIGS.) to draw air into the sole body 19 and spreading the air across the entire foot area. These channels are relatively shallow and the absence of a large reservoir as is employed on certain air shoes causes the air to spread rapidly across the entire foot area and reduced contamination from the outside.

When a wearer of the shoe of the present invention walks, runs, or otherwise exercises it is usual for the foot to go through repetitive motion: usually the heel of the shoe first touches the ground, then the foot rotates to bring the sole into ground contact, then finally the foot is lifted off the ground from the rear of the foot. This provides progressive compression and release from rear to front of the foot and produces progressive compression of the sole of the shoe. In the present invention this causes intake of air to move progressively through the channel network of sole 19.

In Fig. 10 is shown a sole body 19 having a tread body 18, with longitudinal channels 40 and with lateral channels 36 in the ball area and instep area of sole body 19. The front lateral channel or channels 36 terminate in openings 51 at the edges of the sole body 18. As illustrated, the front three of such channels 36 terminate at such openings 51. In the form shown, there are no lateral channels 35 in the heel section of sole body 18, as the longitudinal channels 40 carry air from rear openings 50 through the heel area of the sole body 19. As can be seen, normal walking or running motions by a wearer of the shoe cause air flow into openings 50 at the rear of the shoe, into the sole area and out through the front openings 51, and also distribute this air throughout the entire foot area. Other repeated foot motion in which the toe touches the floor or ground first may cause reverse air flow into fron openings 51 and out rear openings 50.

I claim:

1. In an air shoe having a shoe upper and a sole body joined to the upper, a bottom surface on said sole body having a predetermined tread design on said surface, an upper surface on said sole body, a ventilation channel network on the upper surface of said sole body consisting of a plurality of longitudinal channels in said sole body contiguous with and opening at said upper surface extending from a position within the heel portion of said sole body to a position within the ball portion of said sole body and extending a substantial distance into the ball portion of said sole body, a multiplicity of lateral channels in said sole body contiguous with and opening at said upper surface and crossing said longitudinal channels to divide said upper surface into a multiplicity of individual sections, each section at least partially surrounded by channels, at least one of said lateral channels being in said heel portion, a plurality of said channels being in the ball portion and at least one of said channels being in the instep portion of said sole body, to form an intercommunicating network of channels as an air passage to the various longitudinal and lateral channels across substantially the full area of said sole, including both said heel portion and substantially the full area of said ball portion and to provide massagic action to a wearer's foot as the foot presses on and releases pressure from said sole body, the channel at said instep portion leading from said intercommunicating channel network and terminating in an enlarged mouth at said instep location, said network of channels being protected against lateral exits and entrances for air flow between said instep portion and a location fully within said ball portion of said sole body, whereby air from said instep portion of said sole body is conveyed into said ball portion as said wearer of said shoe exercises.

said mouth having a bottom surface declining downwardly from said channel to an open end at the edge of said sole.

2. A shoe according to claim 1 having a porous inner sole located on the upper surface of said sole body contiguous with said network of channels and extending beyond the edges of the upper surface of said sole body, said inner sole providing 5 lasting between said sole body and said shoe upper and forming a continuous air chamber communicating between the outside air and a wearer's foot throughout the area on the upper surface of said sole body including substantially the entire ball portion of the foot.

3. In a shoe, in combination, a sole body having a predetermined tread design on its bottom surface, an upper surface on said sole body, a multiplicity of longitudinal and lateral channels in said upper surface forming a network of intercommunicating channels and dividing said upper surface into a multiplicity of sections, each section at least partially surrounded by said channels, at least a first one of said lateral channels being at the instep portion of said sole body and leading to an external enlarged mouth at said instep portion, the lateral channels other than said first lateral channels terminating within said sole area and communicating solely with said network of channels, and an inner slip sole having an upper mesh layer adapted to contact a wearer's foot and having a lower foam layer positioned to communicate with said network of channels, an exterior frame on said slip sole attached to the shoe upper to provide lasting thereto and attached to said lower foam layer, the communicating network of channels and the foam layer of the slip sole being adapted to provide air flow to and across substantially the entire foot area.

4. In a shoe according to claim 3, said slip sole comprising an outer frame surrounding a sole area corresponding to the foot area of a shoe, positioned within said frame a breathing area including at least the ball portion of said sole and having an upper mesh layer providing structural strength to said breathing area and a lower foam layer comprising a plastic foam material bonded to the upper mesh layer, the outer frame, the mesh layer and the foam layer being secured together to form a unitary structure.

5. The air shoe of claim 3, wherein at least one of said longitudinal channels terminates in an external opening at the rear of said shoe above the heel portion of said sole body, said longitudinal channel and said lateral channel at said instep portion inter-communicating to provide passage for air flow of external air through said network of channels to at least the ball portion of said sole body.

6. In an air shoe having a shoe upper and a sole body joined to the upper, a bottom surface on said sole body having a predetermined tread design on said surface, an upper surface on said sole body, a ventilation channel network on the upper surface of said sole body having a plurality of longitudinal channels in said sole body contiguous with and opening at said upper surface extending from a position within the heel portion of said sole body to a position fully within the ball portion of said sole body, a multiplicity of lateral channels in said sole body contiguous with and opening at said upper surface and crossing said longitudinal channels to divide said upper surface into a multiplicity of individual sections, each section at least partially surrounded by channels, at least one of said lateral channels being in said heel portion, a plurality of said channels being in the ball portion and at least one of said channels being in the instep portion of said sole body, to form an intercommunicating network of channels as an air passage to the various longitudinal and lateral channels across substantially the full area of said sole, including both heel portion and substantially the entire ball portion and to provide massagic action to a wearer's foot as the foot presses on and releases pressure from said sole body, and means to provide air flow of external air through said network of channels including at least one external opening from a lateral channel at said instep area of said sole body and at least one external opening from a longitudinal channel at said heel area.

* * * * *